United States Patent [19]

Kitamoto

[11] Patent Number: 4,573,869

[45] Date of Patent: Mar. 4, 1986

[54] BLOWER

[75] Inventor: Manabu Kitamoto, Fuji, Japan

[73] Assignee: Tokyo Shibaura Denki Kabushiki Kaisha, Kawasaki, Japan

[21] Appl. No.: 514,030

[22] Filed: Jul. 15, 1983

[30] Foreign Application Priority Data

Jul. 21, 1982 [JP] Japan ..... 57-127116

[51] Int. Cl.[4] ..... F04D 29/44; F04D 29/66

[52] U.S. Cl. ..... 415/182; 415/119; 415/206; 415/208

[58] Field of Search ..... 415/119, 206, 208, 219 C, 415/DIG. 1, 216, 99, 182

[56] References Cited

U.S. PATENT DOCUMENTS

| | | | |
|---|---|---|---|
| 2,287,822 | 6/1942 | Odor et al. | 415/208 X |
| 3,480,202 | 11/1969 | Stephenson, Jr. | 415/208 X |
| 3,775,029 | 11/1973 | Ranz | 415/219 C X |
| 3,856,431 | 12/1974 | Tucker | 415/219 C |

FOREIGN PATENT DOCUMENTS

| | | | |
|---|---|---|---|
| 2027936 | 12/1971 | Fed. Rep. of Germany | 415/182 |
| 2441988 | 3/1975 | Fed. Rep. of Germany | 415/206 |
| 2540580 | 3/1977 | Fed. Rep. of Germany | 415/208 |
| 1305648 | 8/1962 | France | 415/219 C |
| 54-71208 | 5/1979 | Japan . | |
| 505297 | 5/1939 | United Kingdom . | |
| 575909 | 3/1946 | United Kingdom . | |
| 1483455 | 8/1977 | United Kingdom . | |
| 2117050 | 9/1983 | United Kingdom | 415/119 |

*Primary Examiner*—Robert E. Garrett
*Assistant Examiner*—Joseph M. Pitko
*Attorney, Agent, or Firm*—Cushman, Darby and Cushman

[57] ABSTRACT

A blower has a sirocco fan of a substantially cylindrical shape and a fan case containing the fan. A motor for driving the fan is arranged outside the case. The case has a pair of inlets formed opposite to each other at both ends of the fan and an outlet so that outside air is sucked through the inlets into the case and diffused from the outlet by the rotation of the fan. A first wind direction plate is mounted on the outer surface of the case and extends substantially to the center of one of the inlet, thereby straightening the flow of the air from the exterior of the case into the inlet. A second wind direction plate extends from the first plate through the inlet into the fan along the axial and radial directions of the fan, thereby straightening the flow of the air in the case.

7 Claims, 8 Drawing Figures

BLOWER

BACKGROUND OF THE INVENTION

The present invention relates to a blower provided, for example, in an air conditioner.

A blower generally has a fan case, a sirocco fan of substantially cylindrical shape arranged in the case, and a motor for rotatably driving the fan. The case has a pair of inlets respectively opposed to the end openings of the fan, and an outlet disposed radially and outwardly from the fan. When the fan is rotated, the air outside of the case is sucked through the inlets into the case and is then blown out through the outlet.

This blower, however, has a problem in that, when the fan is rotating, a vortex flow may occur in the vicinity of the inlets due to the pressure difference in the case, with the result that the flow of the air sucked from the inlets into the case is disrupted. Thus, the blower has disadvantages in that it is noisy during the blowing operation and the air flow rate may decrease.

In Japanese Utility Model Laid-open Application No. 71,208/1979, a blower is disclosed in which a wind direction plate is mounted on the outer surface of a fan case, thereby preventing the interference of the air flow at the outside edge of the inlets. According to this blower, air can smoothly flow from the inlets into the case. Since a vortex flow is, however, produced in the case of this blower, the blower also cannot effectively reduce the noise nor increase the air flow rate.

SUMMARY OF THE INVENTION

The present invention has been made in consideration of this and has for its object to provide a blower capable of effectively reducing the noise at the blowing time and increasing the air flow rate.

According to an aspect of the invention, there is provided a blower which comprises a sirocco fan of a substantially cylindrical shape, driving means for rotating the fan around the axis of the fan as a center, a fan case for containing the fan, the case including an inlet formed opposite to one end of the fan and an outlet so that air is sucked from the inlet into the case and is blown from the outlet by the rotation of the fan, a first wind direction plate mounted on the outer surface of the case for straightening the flow of the air from outside of the case into the inlet, and a second wind direction plate extending from the first wind direction plate through the inlet into the fan for straightening the flow of the air in the case.

According to the blower of the present invention, the flow of the air from outside of the case into the inlet is straightened by the first wind direction plate, thereby preventing the interference of the air flow and the production of a vortex flow. Therefore, the air can be smoothly flowed from the inlets into the case. The flow of the air in the case is further straightened by the second wind direction plate, thereby preventing the interference of the air flow and the production of a vortex flow. In this manner, the fan can be smoothly rotated. Accordingly, the blower of the present invention can reduce both noise and vibration during the blowing operation and can also increase the air flow rate as compared with the conventional blower.

BRIEF DESCRIPTION OF THE DRAWINGS

FIGS. 1 and 2 show an air conditioner having a blower according to a first embodiment of the present invention; in which FIG. 1 is a sectional view taken along a line I—I in FIG. 2, and FIG. 2 is a sectional view taken along a line II—II in FIG. 1;

FIGS. 3 to 6 show the blower; in which FIG. 3 is a perspective view, FIG. 4 is a side view, FIG. 5 is a partially broken front view, and FIG. 6 is a sectional view taken along a line VI—VI in FIG. 5;

DETAILED DESCRIPTION OF THE PREFERRED EMBODIMENTS

Embodiments of the present invention will be described in detail with reference to the drawings.

Figure 1:
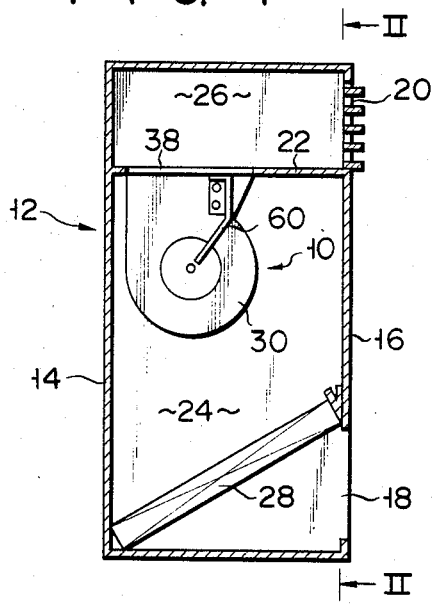
Figure 2:
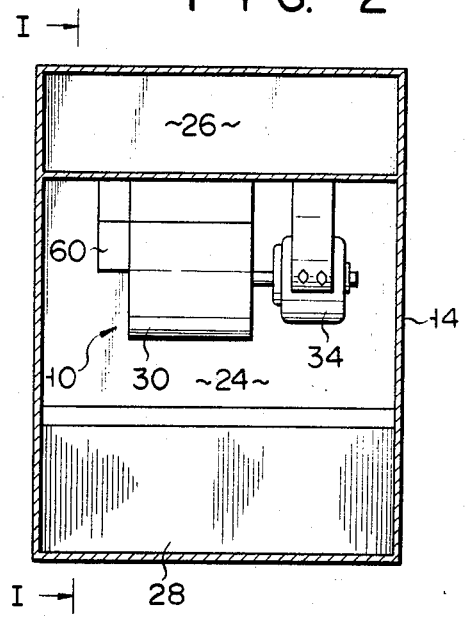
Figure 3:
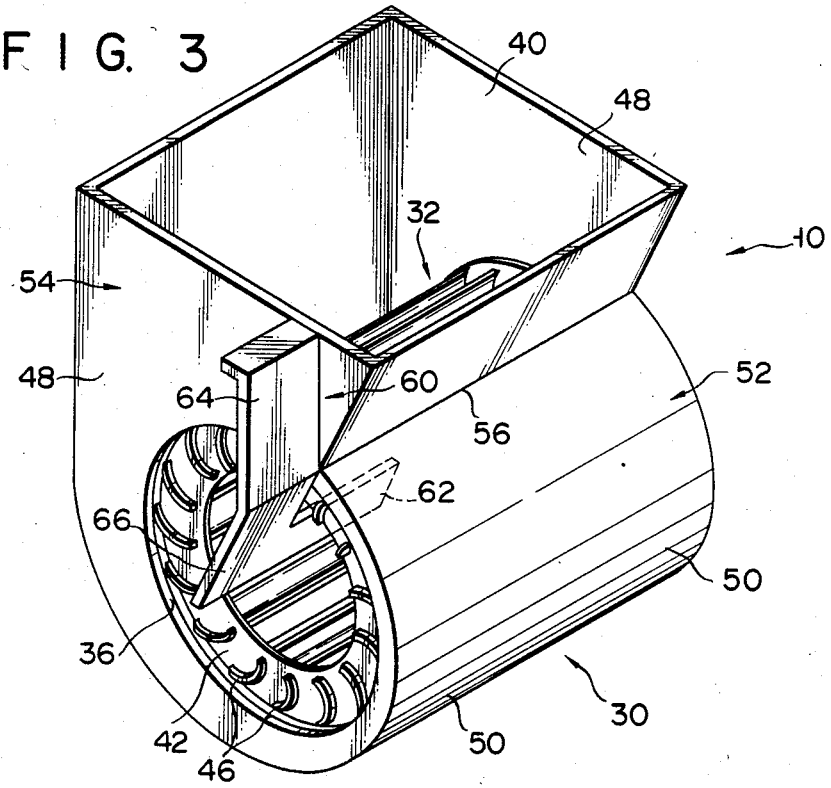

FIGS. 1 and 2 show an air conditioner 12 having a blower 10 according to a first embodiment of the present invention. The air conditioner 12 has a body 14 of a rectangular box shape, a suction port 18 formed at the lower portion of a front panel 16, and a diffuser 20 formed at the upper portion of the panel 16. The interior of the body 14 is divided via a partition plate 22 into a suction chamber 24 communicating with the port 18 and a diffusing chamber 26 communicating with the diffuser 20. The blower 10 and a heat exchanger 28 are arranged in the chamber 24, and the blower 10 is supported by the plate 22.

The blower 10 has, as will be described in detail, a fan case 30, a sirocco fan 32 contained in the case 30 and a motor 34 for driving the fan 32. The case 30 has a pair of inlets 36 and an outlet 40 communicating with the chamber 26 through a communication port 38 formed at the plate 22. When the fan 32 is rotated by the motor 34, the air in the chamber 24 is sucked through the inlets 36 into the case 30, and is further diffused through the ports 38 and 40 into the chamber 26. Therefore, the air sucked from the port 18 into the body 14 is heat exchanged by the exchanger 28, and is then diffused externally from the diffuser 20.

As shown in FIGS. 3 to 6, the blower 10 has a sirocco fan 32 of a substantially cylindrical shape and a fan case 30 containing the fan 32. The fan 32 has a pair of annular end plates 42 arranged coaxially and opposite to each other, a supporting plate 44 of disc shape arranged coaxially with the end plates at the center between the end plates, and a number of blades 46 supported by the end plates 42 and supporting plate 44 and aligned along the end plates 42. The case 30 has a pair of side plates 48 opposed to each other, and a peripheral plate 50 arranged along the side edges of the respective side plates 48. A circular inlet 36 is formed at each side plate 48. The inlets 36 are respectively disposed adjacent to, opposite to and coaxially with the end openings and hence the end plates 42 of the fan 32. The case 30 has a containing portion 52 of substantially cylindrical shape containing the fan 32, and a guide portion 54 gradually expanding and extending upward from the containing portion 52, and an outlet 40 of rectangular shape is defined at the extended end of the guide portion 54. As evident from FIG. 4, the right side surface of the guide portion 54 extends along the radial direction of the inlets 36, and a casing nose 56 is formed in the boundary between the right side surface of the guide portion 54 and the containing portion 52.

The blower 10 has a motor 34 for driving the fan 32, and the motor 34 is supported by the partition plate 22 (FIG. 2) of the air conditioner 12. The rotational shaft 58 of the motor 34 extends through the inlet 36 into the case 30 and is disposed coaxially with the fan 32. The extended end of the shaft 58 is fixed to the supporting plate 44 of the fan 32, and the fan 32 is supported by the shaft 58 in this manner.

Figure 5:
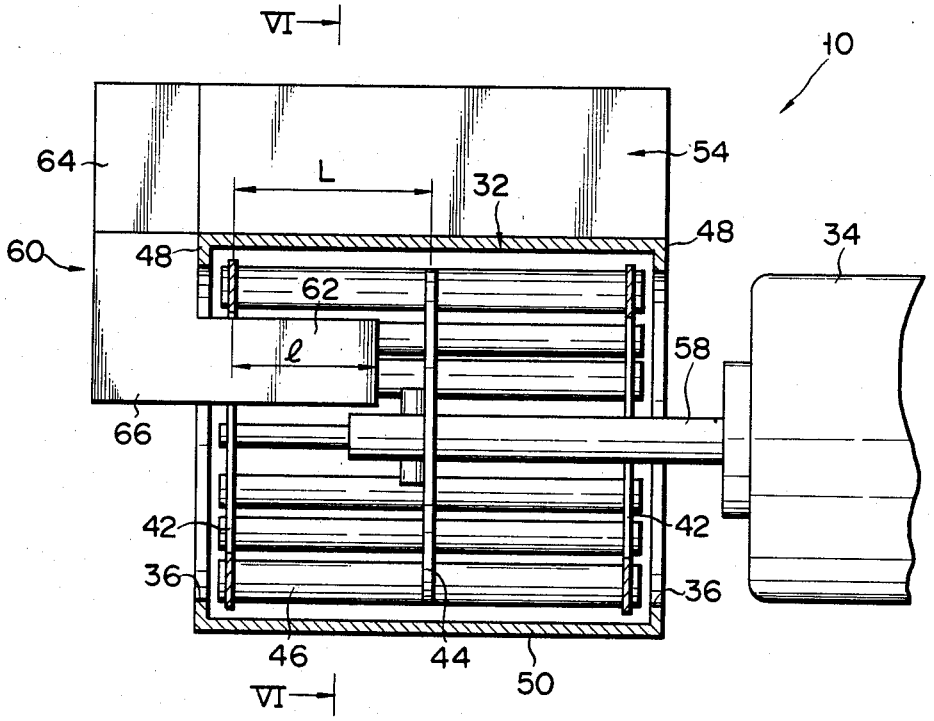
Figure 6:
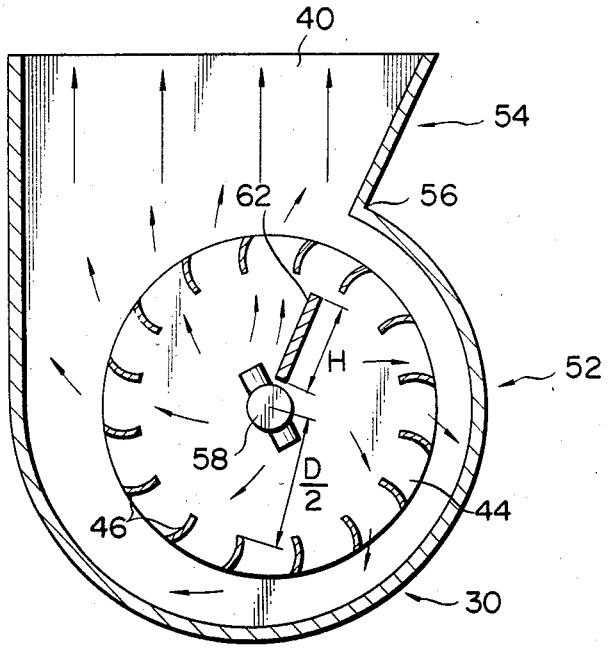

Further, the blower 10 has first and second wind direction plates 60 and 62 mounted on the left side plate 48 in FIG. 5. The first plate 60 is erected on the guide portion of the side plate 48, and has an upper half portion 64 extending vertically from the top of the guide portion to the casing nose 56, and a lower half portion 66 extending from the nose 56 substantially to the center of the inlet 36 formed at the left side plate. The second plate 62 extends from the lower half portion 66 of the first plate 60 through the inlet 36 and the opening of the end plate 42 into the case 30. The second plate 62 extends along the axial direction of the fan 32 to the vicinity of the plate 44. The second plate 62 is disposed, as seen from FIG. 6, along the radial direction of the fan 32 in the same plane as the lower half portion 66 of the first plate 60. As shown in FIG. 5, the value $l/L \times 100\%$ is set to approx. 30% to 90%, where l represents the length from the end plate 42 to the extended end of the second plate 62, and L represents the length between the end plate 42 and the plate 44.

According to the blower 10 described above, when the fan 32 is rotated, the air outside of the case 30 is sucked from the inlets 36 into the case 30 and is diffused from the outlet 40. The flow of the air sucked from the exterior of the case 30 into the inlets 36 is straightened by the first plate 60, thereby preventing the interference and the production of a vortex flow. Thus, the air is smoothly flowed from the inlets 36 into the case 30. Further, the flow of the air in the case is straightened by the second plate 62, thereby further preventing the interference and the production of a vortex flow. In this manner, the fan 32 can be smoothly rotated. Therefore, the blower 10 of the present invention can reduce both noise and vibration during the blowing operation and can increase the air flow rate as compared with the conventional blower.

Figure 7:
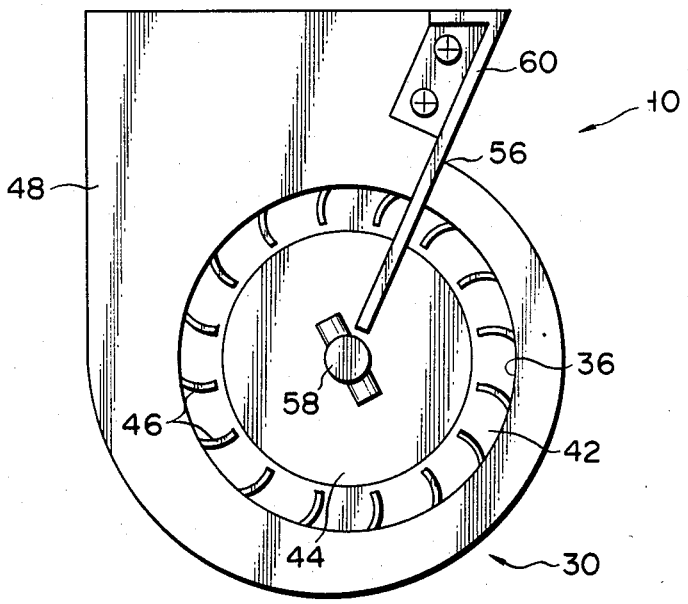
FIG. 7 is a side view of a blower according to a second embodiment of the present invention.

As shown in FIG. 7, the first plate 60 may be made linear. In this embodiment, the plate 60 extends from the top of the case 30 substantially to the center of the inlet 46 and particularly extends along the direction passing through the center of the inlet 36 and the casing nose 56. Even in the blower of this embodiment, advantages similar to the above embodiment can be obtained.

Figure 4:
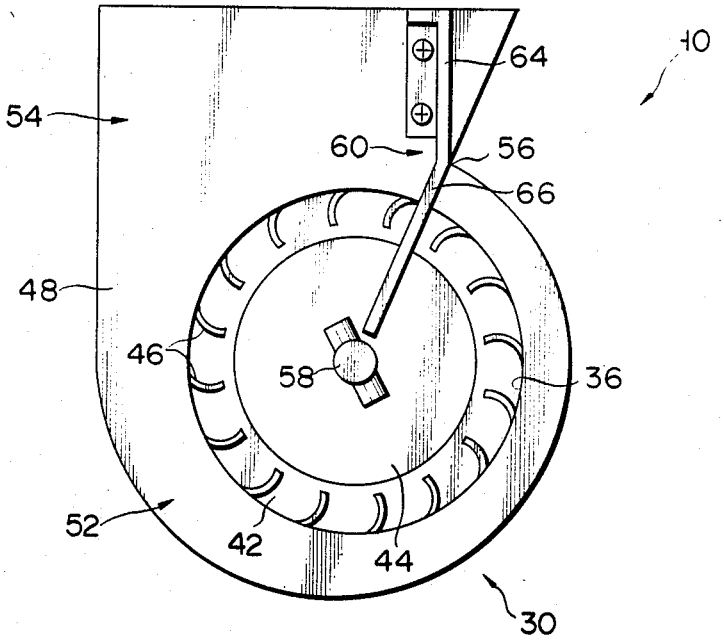

The applicant has measured the rotating speeds of the motor and the values of the noise where the air flow rates of the blowers of the following embodiments were maintained at 3,000 $m^3$/hr; in embodiment (I) no wind direction plate is provided, in (II) only the first wind direction plate 60 is provided, (III) is the embodiment shown in FIG. 4, and (IV) is the embodiment shown in FIG. 7. The measured results are as listed in the following Table.

TABLE

| | Air Flow ($m^3$/hr) | Motor Speed (r.p.m.) | Noise Value (dB) |
|---|---|---|---|
| (I) | 3000 | 1060 | 58.8 |
| (II) | 3000 | 950 | 57.0 |
| (III) | 3000 | 870 | 55.5 |

TABLE-continued

| | Air Flow ($m^3$/hr) | Motor Speed (r.p.m.) | Noise Value (dB) |
|---|---|---|---|
| (IV) | 3000 | 875 | 55.5 |

Figure 8:
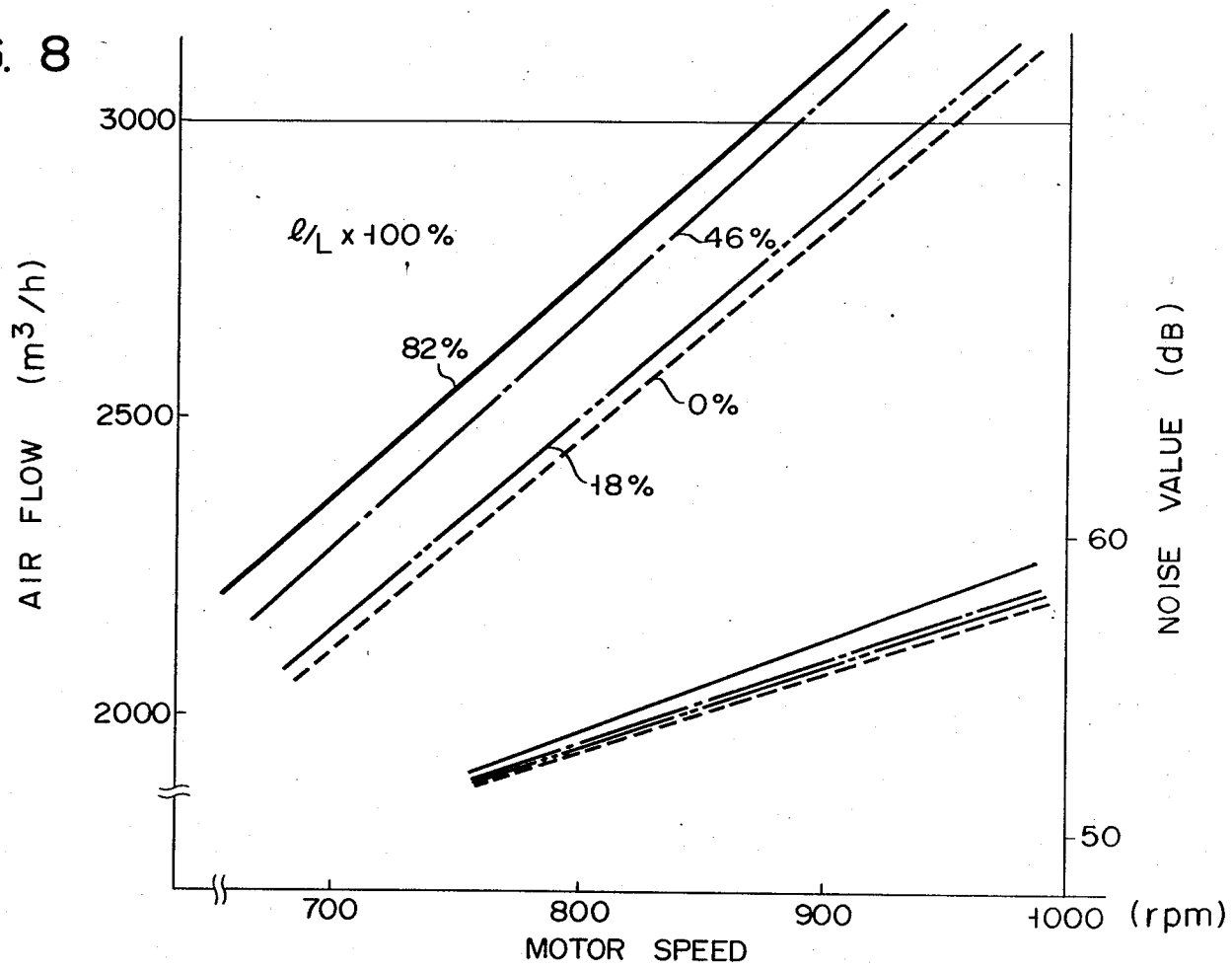
FIG. 8 is a graph showing the relationship of the air flow rate and noise value to the length of a second wind direction plate.

Further, the applicant has measured the variation of the air flow rate and noise in relation to the viriation in the length l of the second plate 62. The measured results are shown in FIG. 8. As evident from these measured results, a 3000 $m^3$/hr air flow rate can be maintained at a lower rotating speed of the motor when the first and second plates 60 and 62 are provided than when no wind direction plate is provided and when only the first plate 60 is provided. In other words, the blower of the present invention can blow air more efficiently than the conventional blower. Therefore, the blower of the present invention can reduce vibration and noise and can also decrease power consumption. Further, it is understood that the longer the second wind direction plate is, the greater the performance. Hence, it would be desirable that the second wind direction plate 62 be made as long as possible toward the supporting plate 44.

Let D denote the length of the plate 62 extending in the radial direction of the sirocco fan 44 and let D designate the inner diameter of the sirocco fan 44. It was found, the more H approaches D/2, the better. In other words, the longer the plate 62 extends from the inner surface of the sirocco fan 44 toward the axis of the fan 44, the greater the performance of the blower. The second wind direction plate 62 should not extend beyond the axis of the fan 44. Otherwise, it would disturb the vortex, the center of which is located near the axis of the sirocco fan 44, to thereby reduce the efficiency of the blower.

The present invention is not limited to the particular embodiments described above. Various other changes and modifications may be made within the spirit and scope of the present invention. For example, in the embodiments described above, the wind direction plates are provided only on one side of the fan case. However, the wind direction plates may be provided at the side plates on both sides.

What is claimed is:

1. A blower comprising:

a sirocco fan of substantially cylindrical shape and having a central axis;

driving means for rotating the fan around said central axis;

a fan case including a containing portion of substantially cylindrical shape for coaxially containing the fan, a circular inlet opposite to one axis end of the fan and a guide portion extending from the containing portion and defining an outlet at its extended end, and a casing nose defined in the boundary between the containing portion and the guide portion, wherein air is sucked through the inlet into the case and diffused from the outlet by the rotation of the fan;

a first wind direction plate mounted on the outer surface of the case for straightening the flow of the air from the exterior of the fan case into the inlet, the first wind direction plate having a portion which extends from near the center of the inlet toward the casing nose; and a second wind direction plate for straightening the flow of the air at suction and discharge regions in the fan case, said second plate extending from the first plate through the inlet into the fan along the axial direction of the fan and radially extending substantially from the center of the fan toward the casing nose.

2. A blower according to claim 1, wherein said fan case comprises of a pair of side plates opposite to each other and a peripheral plate disposed between the side plates and arranged along the side edge of each side plate and wherein said inlet has a circular shape and is coaxially formed with the fan at one of the side plates.

3. A blower according to claim 2, wherein said first wind direction plate is erected on the outer surface of the side plate having the inlet, and includes an upper half portion extending vertically from the end edge of the side plate at the outlet side to the casing nose and a lower half portion extending from the casing nose substantially to the center of the inlet, and said second wind direction plate extends from the extended end of the lower half portion of the first wind direction plate into the case and is disposed in the same plane as the lower half portion of the first wind direction plate.

4. A blower according to claim 3, wherein said sirocco fan includes a pair of annular end plates opposed to each other, a supporting member disposed substantially at the center between and opposite to the end plates, and a number of blades mounted on the end plates and supporting member and aligned along the end plates; said dirving means includes a motor arranged outside the case, the rotational shaft of the motor extends through the inlet into the fan, is disposed coaxially with the fan, is attached to the supporting member for supporting the fan, and said second wind direction plate extends to the vicinity of the supporting member along the axis of the fan and extends from the vicinity of the inner peripheral edge of the fan to the vicinity of the rotating axis of the fan along the radial direction of the fan.

5. A blower according to claim 2, wherein said first wind direction plate is erected on the outer surface of the side plate having the inlet, and extends linearly from the end edges of the side plate at the outlet side through the casing nose substantially to the center of the inlet, and said second wind direction plate extends from the extended end of the first wind direction plate into the case, and is disposed in the same plane as the first wind direction plate.

6. A blower according to claim 5, wherein said sirocco fan includes a pair of annular end plates opposed to each other, a supporting member disposed substantially at the center between and opposite to the end plates, and a number of blades mounted on the end plates and supporting member and aligned along the end plates; said driving means includes a motor arranged outside the case, the rotational shaft of the motor extends through the inlet into the fan, is disposed coaxially with the fan, is attached to the supporting member for supporting the fan, and said second wind direction plate extends to the vicinity of the supporting member along the axis of the fan and extends from the vicinity of the inner peripheral edge of the fan to the vicinity of the rotating axis of the fan along the radial direction of the fan.

7. A blower according to claim 1, wherein said fan case has another inlet formed opposite to the other axial end of the fan.

* * * * *